United States Patent [19]

Rutten

[11] 4,366,690

[45] Jan. 4, 1983

[54] CENTRIFUGAL SHOTTING TURBINE

[75] Inventor: Léon Rutten, Liege, Belgium

[73] Assignee: Cockerill Sambre, Seraing, Belgium

[21] Appl. No.: 89,461

[22] Filed: Oct. 30, 1979

Related U.S. Application Data

[63] Continuation-in-part of Ser. No. 962,190, Nov. 20, 1978, abandoned.

[30] Foreign Application Priority Data

Nov. 24, 1977 [BE] Belgium ..... 46239

[51] Int. Cl.[3] ..... B24C 3/24

[52] U.S. Cl. ..... 72/53

[58] Field of Search ..... 72/53; 29/DIG. 36; 51/319, 320, 321, 435, 434, 410, 419, 423, 424

[56] References Cited

U.S. PATENT DOCUMENTS

| | | | |
|---|---|---|---|
| 2,108,211 | 2/1938 | Rosenberger | 51/434 |
| 3,678,629 | 7/1972 | Leliaert | 51/435 |
| 3,785,105 | 1/1974 | Freeman | 51/435 |
| 3,872,624 | 3/1975 | Ramasamy | 51/435 |
| 4,028,851 | 6/1977 | Fricke | 51/424 |

FOREIGN PATENT DOCUMENTS

| | | | |
|---|---|---|---|
| 834341 | 3/1952 | Fed. Rep. of Germany | 51/434 |
| 559084 | 2/1975 | Switzerland | 51/435 |
| 518803 | 3/1940 | United Kingdom | 51/435 |
| 743381 | 1/1956 | United Kingdom | 51/434 |

*Primary Examiner*—Gene Crosby

*Attorney, Agent, or Firm*—Spencer & Kaye

[57] ABSTRACT

A shotting turbine having blades with working faces having a longitudinal profile comprising a convex part and a concave part with angles of curvature chosen to provide an optimized rate of ejection of the shot and a high concentration of the jet.

2 Claims, 4 Drawing Figures

CENTRIFUGAL SHOTTING TURBINE

The present application is a continuation-in-part of Ser. No. 962,190 filed Nov. 20, 1978, now abandoned.

BACKGROUND OF THE INVENTION

The present invention relates to a shotting turbine allowing a rate of ejection of the shot and a concentration of the jet of shot superior to those of known shotting turbines.

Shotting turbines are used to fling shot onto the surface of a metal part in order to give this surface a desired state of roughness. Turbines of the centrifugal type comprise a central delivery device which provides a supply of shot and a plurality of blades or vanes arranged radially around the delivery device and fixed to one or two flanges. The effective surface of these blades is conventionally plane and of uniform width.

This straight blade arrangement flings the shot at a rate of ejection directly dependent on the rate of rotation of the turbine. In certain cases, this rate can be too low to achieve the purpose desired. The impact of the particle, namely, its energy $E=(m\ V^2_R)/2$ where m=the mass of a particle, is, in fact, the function of the square of the rate of ejection $V_R$.

Certain parts to be shot, for example, rolling-mill rolls, are so hard that the desired degree of roughness cannot be achieved with a straight blade arrangement. Like any machine, the shotting turbine has a limiting speed which cannot be exceeded for reasons of safety and wear among others. The straight blade arrangement does not allow a rate of ejection of the shot to be produced which exceeds that corresponding to the limiting rate of rotation of the turbine. For example, a turbine with straight blades, rotating at a speed of 2,500 revolutions per minute would provide a rate of ejection of shot of approximately 77.77 m/s.

A higher rate of ejection has definite advantages however. In the first place, to obtain the same level of roughness the rate of rotation can be lower. The rate of rotation of the turbine is an important element, since in a shotting turbine the differential wear of the blades and flanges brings about troublesome imbalances (vibrations). As these imbalances are a direct function of the square of the rate of rotation they are reduced at the same time as the latter. It is therefore important to reduce as far as possible these disruptive forces and an extremely effective means is therefore to reduce the rate of rotation of the turbine.

On the other hand, a higher rate of ejection than with the straight blade arrangement enables higher degrees of roughness to be obtained from the same rate of rotation. In the particular case of rolling-mills rolls, for example, the roll hardnesses achieved at the present time cannot be increased, since impossibility of shotting is quickly reached, namely, the impossibility of attaining the required degree of roughness. There is therefore often in this field a compromise between the desired degree of roughness and the roll hardness which is as high as possible but permits the attainment of the required degree of roughness. For example, with angular shot composed of particles having an average size of 0.40 mm and width a roll hardness of 730–750 Vickers hardness under a load of 30 kg (HV), the maximum degree of roughness reached is 200μ" (CLA: Center Line Average). If the roll hardness is increased by 30 points on the Vickers hardness scale, the maximum possible degree of roughness will be, for example, 170μ" (CLA).

Merely using curved blades does not solve the problem of improving satisfactorily the rate of ejection of the shot. It has been found, indeed, that the rate of ejection is a function of the friction coefficient of the blade and the angle of curvature thereof, and that using blades with working faces having a convex longitudinal profile only provides a slight increase of the rate of ejection of shot for a small angle value. Increasing the value for said angle of curvature rapidly causes the rate of ejection to decrease as low as a level below the rate of ejection for straight blades.

A first object of this invention is to provide a shotting turbine having blades with working faces having a longitudinal profile optimized so as substantially to improve the rate of ejection of the shot.

Another aspect of this invention relates to the concentration of the jet of shot which is spread out both in the direction of movement of the turbine and in a transverse direction. To take a specific example, with a turbine rotating at a speed of 2,500 revolutions per minute and having straight blades with a uniform width of 60 mm, the spreading of the shot gives at a distance of 500 mm from the turbine a jet having an impact length of approximately 793 mm and an impact width of approximately 80 to 90 mm. It has been established that if the central part of the jet produces a uniform roughness on the surface which it touches, the marginal parts of the spread jet contain particles of shot which rebound on the surface to be shot, which break down and which have an impact effect which is prejudicial to the efficiency of the operation. This spreading of the jet thus appreciably limits the impact force of the jet and it is especially troublesome in the shotting of parts having a curved surface, for example, rolling-mill rolls. The improvement in the transverse concentration of the jet of shot brings about a reduction in the spread of the jet, the effect of which is to increase the impact power of the jet for the same delivery of shot.

SUMMARY OF THE INVENTION

In the shotting turbine according to the invention, the blades arranged around the shot delivery device have each a working face having a longitudinal profile comprising, starting from the shot delivery device, a convex part with an angle of curvature of at least 10°, followed by a concave part with an angle of curvature not exceeding approximately 55°.

Advantageously, the working face of each blade has outwardly symmetrically converging lateral flanks forming between them an angle of approximately 3°.

DESCRIPTION OF EXEMPLARY EMBODIMENTS

Figure 1:
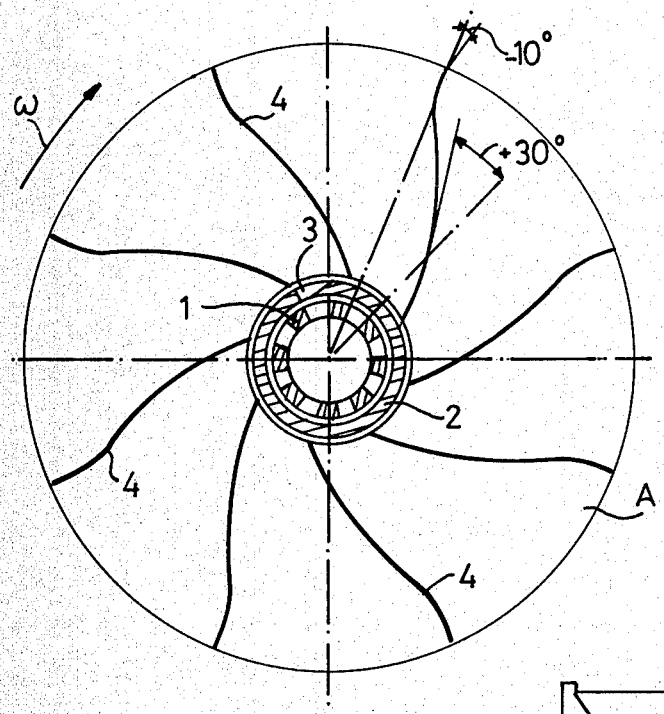
FIG. 1 is a schematic cross-section of a turbine according to the invention.

FIG. 1 shows a schematic cross-section of a shotting turbine according to the invention. Arranged around a shot delivery device 1 is a regulator 2 which consists of a casing pierced by an opening 3 whose size is a function of the turbine and of the shotting work to be carried out. A plurality of blades 4 fixed between two flanges, one of which is shown at A on the drawing, are arranged uniformly around the regulator 2. The turbine is assumed to be driven in the direction of rotation indicated by the arrow W.

According to the invention the working faces of the blades 4 have a longitudinal profile composed, starting from the delivery device 1, of a convex part followed by a concave part.

Two facts have been found: (a) the tangential rate of the shot along the convex part of the working face increases with the angle of curvature of said convex part; (b) the rate of ejection of the shot increases as a function of the angle of curvature of the concave part of the working face up to a limit for said angle of curvature. Theoretically, the angle of curvature of the convex part can be chosen as high as possible in order to increase the tangential rate of the shot but however, the higher said angle, the higher the friction of the shot in the concave part of the working face, which decreases the tangential rate of the shot. Also, the wear is significantly increased. It results from these statements that, for a given rotating speed and a given diameter for the turbine, the optimization of the rate of ejection of the shot requires a compromise to be chosen for the angles of curvature for the convex and concave parts of the working faces of the blades. As a practical matter, it has been found that the angle of curvature for the convex part of the working face should be at least 10° and the angle of curvature for the concave part should not exceed a limit value of approximately 55°. Designing blades having a longitudinal profile as defined above provides an improvement in the rate of ejection of the shot as high as approximately 20%, which permits a significant improvement in the degree of roughness which can henceforth be attained.

Figure 2:
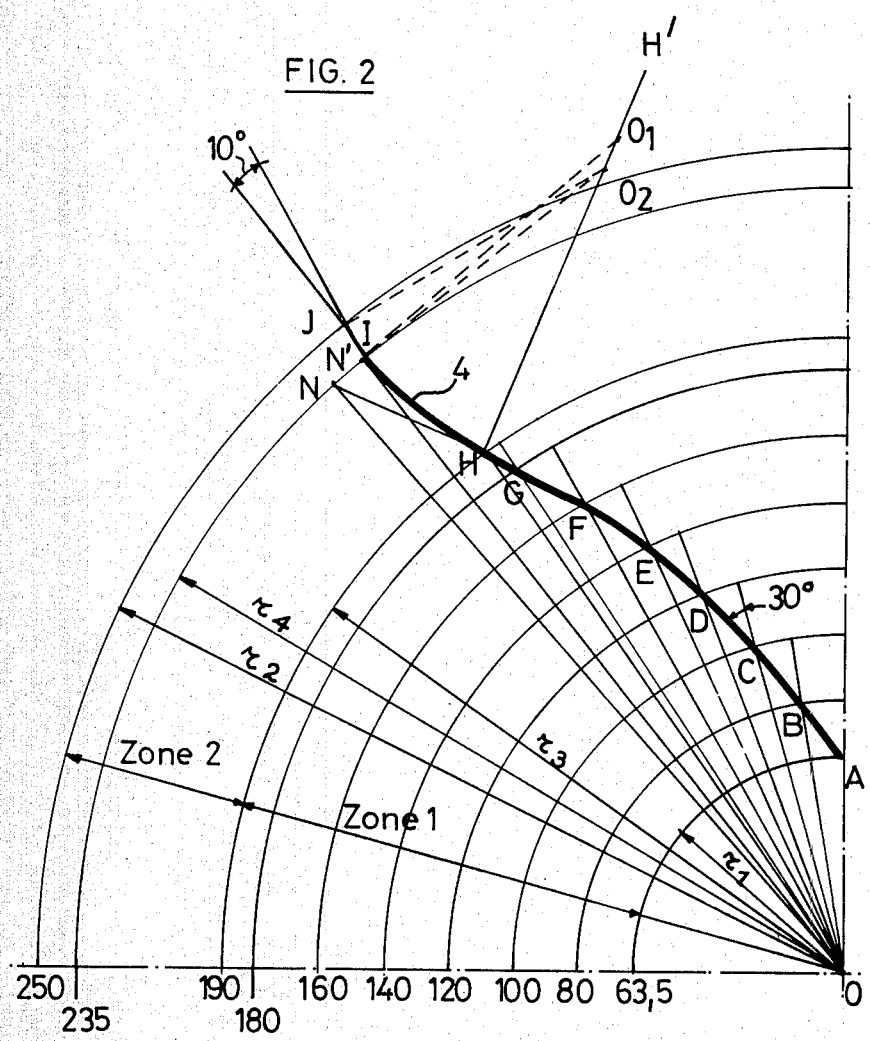
FIGS. 2 and 3 are two embodiments of longitudinal profile of a blade of a turbine according to the invention.
Figure 3:
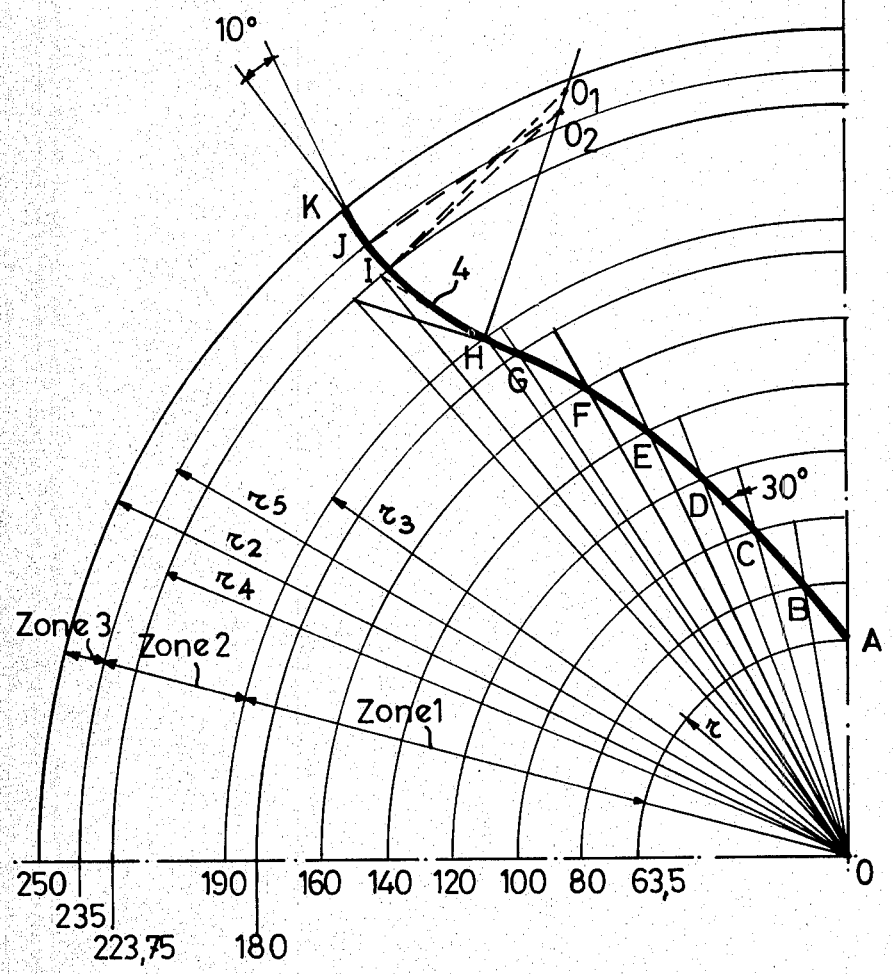

Two examples of a profile in accordance with the invention are illustrated in FIGS. 2 and 3.

In the exemplary embodiment of FIG. 2, the longitudinal profile is divided into two zones: zone 1 which extends as far as the radius $r_3=190$ mm and zone 2 which extends from the radius $r_3$ to the radius $r_2=250$ mm. In zone 1 the working face of the blade is convex with a uniform angle of curvature which illustratively is 30°. At each of the points A, B, C, D, E, F, G and H the tangent at this point to the profile of the effective face forms an angle of 30° with the radius passing through this point. The number of pitches is selected so as to obtain a polygonal curve practically identical to the theoretical curve.

In zone 2 the working face of the blade is concave with an angle of curvature variable between the value of 30° and the value of −10° selected as an example of the exit angle. The variation of the angle of curvature is therefore 30°−(−10°)=40°. The curve is adjusted in proportion to the two angles of curvature, namely:

30/40 to adjust the angle $\alpha_1=30°$ at the radius $r_3=190$ mm to $\alpha=0°$ at the radius $r_4=235$ mm;

10/40 to adjust the angle $\alpha=0°$ at the radius $r_4=235$ mm to the value $\alpha_2=-10°$ at the radius $r_2=250$ mm.

The profile in this zone 2 can be plotted in the following manner. Draw from the point H a straight line forming an angle of 30° with the radius HO: this straight line intersects the circumference of radius $r_4=235$ mm at the point N. Mark the radius NO and draw at the point N the perpendicular to this radius NO. Likewise, draw through the point H the perpendicular to HN that is, HH': the intersection of the perpendicular at N and the straight line HH' defines the point $O_1$. With $O_1$ taken as the centre, draw a segment of circle of radius $O_1H$: this segment of circle bisects the circumference of radius $r_4$ at the point N'. Draw through this point the perpendicular to the radius N'O to define the point $O_2$ on the straight line HH'. With this point $O_2$ selected as the new centre, plot a segment of circle of radius $O_2H$ which bisects the circumference of radius $r_2$ at the point J. As will be noted, a step-by-step operation is required, but two locations of centres ($O_1$, $O_2$) are largely sufficient for the accuracy required.

FIG. 3 shows a second embodiment of a blade with double curvature according to the invention. In this embodiment the profile is divided into three zones: zones 1 and 2 correspond to the two zones of the embodiment of FIG. 2, while zone 3 is a zone in which the angle of curvature is constant. The profile shown in FIG. 3 thus comprises a line convex to the constant angle of curvature (zone 1), a line concave to the variable angle of curvature (zone 2) and a line concave to the constant angle of curvature (zone 3). This profile having three zones is plotted as in the case of the profile having two zones for the zones 1 and 2; in zone 3 it can be plotted as for the line of zone 1. In the embodiment shown in FIG. 3, since the outer radius $r_2$ is the same as in the embodiment of FIG. 2, the three zones are distributed as follows: zone 1 as far as the radius $r_3=190$ mm, zone 2 as far as the radius $r_5=235$ mm and zone 3 from the radius $r_5$ to the radius $r_2=250$ mm.

The theoretical rate of ejection of shot calculated for blades having the profile of FIG. 3 for the same rate of rotation of 2,500 revolutions per minute is slightly lower than that obtained with blades having the profile of FIG. 2 (namely, 91.62 m/s instead of 92.62 m/s). Moreover, there would be a slight increase in the wear of the blades.

Figure 4:
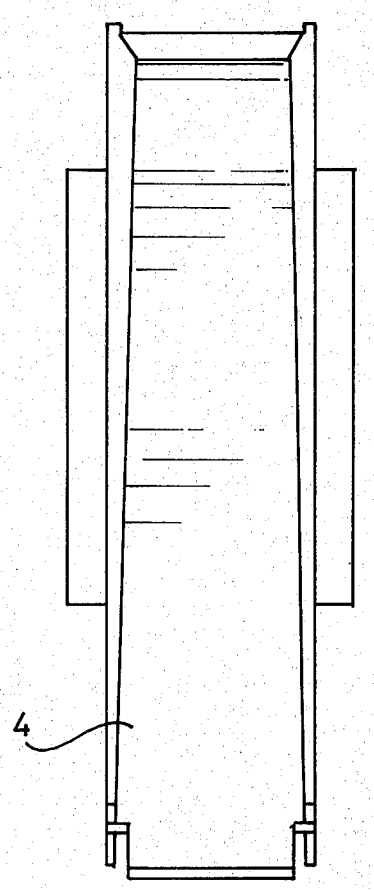
FIG. 4 is a front view of a blade of a turbine according to the invention.

To improve the transverse concentration of the jet of shot, the working face of each blade has a width which decreases progressively from its foot to its head. This transverse profile is shown in FIG. 4. The progressive reduction of the width of the blade is advantageously such that the lateral flanks of the blade form between them an angle of approximately 3°. Owing to this profiling it is possible to obtain a transverse concentration of the jet improved in a proportion of approximately 48% in relation to a blade arrangement having a uniform width, all other factors being equal. Thus, with the blade arrangement according to the invention the projection of marginal particles in a transverse direction is substantially reduced, so that the power and effectiveness of the impact are considerably improved.

What is claimed is:

1. A centrifugal shotting turbine for ejecting a jet of shot, comprising:

a shot delivery device;

first and second spaced flanges, said flanges being located on opposite sides of said shot delivery device; and a plurality of blades interposed between said first and second flanges and projecting radially outward from said shot delivery device, each of said blades having a working face on which shot from said delivery device impinges when said blades are rotated in a given direction about an axis of rotation, the working face of each of said blades comprising a first zone adjacent said shot delivery device wherein said working face is convex and at each point thereof a tangent to the face of the blade makes a fixed angle of curvature with a radius through said point and the axis of rotation, said fixed angle of curvature being between 10° and 30°, the working face of said blade further comprising a second zone adjacent said first zone wherein said working face is concave and at each point thereof a tangent to the face of the blade makes an angle of curvature with a radius through said point and the axis of rotation which varies from the end of said second zone adjacent said first zone to the other end of said second zone, said angles of curvature in said second zone being between 10° and 55°, the ratio of the radial distance between said axis of rotation and the other end of said second zone to the radial distances between said axis of rotation and the juncture of said first and second zones being approximately 1.2, the shape of said working face providing a relatively high rate of shot ejection at relatively moderate blade rotation speeds.

2. A centrifugal shotting turbine according to claim 3, wherein the working face of each blade has outwardly symmetrically converging lateral flanks forming between them an angle of approximately 3°.

* * * * *